US006805123B2

(12) United States Patent
Seo

(10) Patent No.: US 6,805,123 B2
(45) Date of Patent: Oct. 19, 2004

(54) COMPACT MULTIPURPOSE DUSTPROOF MASK

(76) Inventor: Jung-Eun Seo, 11-704 Hyundai Apt. 56, Myeongil-dong, Kangdong-gu, Seoul (KR), 134-070

( * ) Notice: Subject to any disclaimer, the term of this patent is extended or adjusted under 35 U.S.C. 154(b) by 0 days.

(21) Appl. No.: 10/168,595

(22) PCT Filed: Dec. 22, 2000

(86) PCT No.: PCT/KR00/01515

§ 371 (c)(1),
(2), (4) Date: Nov. 26, 2002

(87) PCT Pub. No.: WO01/45797

PCT Pub. Date: Jun. 28, 2001

(65) Prior Publication Data

US 2003/0136409 A1 Jul. 24, 2003

(30) Foreign Application Priority Data

Dec. 22, 1999 (KR) ..... 1999-29218

(51) Int. Cl.[7] ..... A62B 23/02

(52) U.S. Cl. ..... 128/206.12; 128/205.27; 128/205.29; 128/206.11; 128/206.17; 128/206.13

(58) Field of Search ..... 128/206.12, 206.17, 128/205.25, 207.11, 206.11, 201.25, 201.26, 205.29, 206.13

(56) References Cited

U.S. PATENT DOCUMENTS

| | | | | | |
|---|---|---|---|---|---|
| 1,175,799 | A | * | 3/1916 | Niessner | 128/206.11 |
| 1,362,766 | A | * | 12/1920 | McGargill | 128/205.27 |
| 2,340,223 | A | * | 1/1944 | Kril | 128/206.11 |
| 3,838,686 | A | * | 10/1974 | Szekely | 128/200.18 |
| 4,022,202 | A | * | 5/1977 | Price | 128/205.24 |
| 5,113,857 | A | * | 5/1992 | Dickerman et al. | 128/207.18 |

* cited by examiner

*Primary Examiner*—Henry Bennett
*Assistant Examiner*—Mital Patel
(74) *Attorney, Agent, or Firm*—Volpe and Koenig, P.C.

(57) ABSTRACT

A compact multipurpose dustproof mask includes a body pipe having an outlet hole formed at one end and a mouth contact hole formed at the other end thereof, and the end where the mouth contact hole is formed is held in the mouth and/or nose, a backward flow preventing ball installed to be capable of moving back and forth and pressed by a returning means in a direction to block a narrow hole formed inside the body pipe so that the body pipe can be open/shut according to pressure of internal air, and a branch pipe formed between the mouth contact hole of the body pipe and the backward flow preventing ball, the branch pipe having an inlet hole having a shape corresponding to a filter formed at one end thereof so that the filter is connected. Thus, the manufacturing cost and the size of a product can be reduced. Also, the mask can be easily carried and kept.

13 Claims, 5 Drawing Sheets

COMPACT MULTIPURPOSE DUSTPROOF MASK

TECHNICAL FIELD

The present invention relates to a compact multipurpose dustproof mask, and more particularly, to a compact multipurpose dustproof mask which can be manufactured with a compact size by consolidating functions so that the unit cost of products can be reduced and carrying and keeping the products is made convenient.

BACKGROUND ART

In general, a dustproof mask is used to protect the health of a worker at an industrial field where a lot of dust is generated. The dustproof mask has a function of preventing dirt or dust from entering a human body while one breathes.

A typical dustproof mask has a structure of sealing the mouth and nostrils by using a cover cloth formed of multiple layered porous material having cords so that a user can wear the cover cloth over his mouth and nostrils by hooking the cords around the back of his ears. Thus, breathing is relatively easy but the dust protection provided by the mask is very poor. Also, such a dustproof mask cannot protect the user from toxic gas generated at a site where a fire occurs or a poisonous material treating place.

Also, water drops are formed on the cover cloth covering a mouth area during breathing so that the cover cloth becomes unsanitary. Since long-term use of the mask may cause itchy skin and other skin troubles, workers are reluctant to use the mask. Furthermore, since it is very difficult to clean the mask to remove dust stacked on the cover cloth, a mask which has been used for a long time is disposed of and a new mask is needed. Thus, the cost of the mask in this regard is raised while environmental pollution becomes an issue due to the disposed waste.

To solve the above problems, a gas mask having a separate filter has been previously developed. However, the gas mask makes breathing difficult and the production thereof is too expensive. Also, water drops occurring during breathing cannot be prevented from adhering to the face of a user, and since the size of the gas mask is too large it is difficult to carry and keep it.

Thus, since it is difficult to prepare gas masks at places such as public bars, lodging houses, offices, work places, and houses, or for an individual to carry, due to the above drawbacks, a large number of casualties is generated due to suffocation, which is the first cause of death from a fire.

DISCLOSURE OF THE INVENTION

To solve the above problems, it is an objective of the present invention to provide a compact multipurpose dustproof mask which enables easy breathing and simultaneously provides superior dust protection and gas (oxygen) breathing performance so that a loss of lives can be minimized.

Also, it is another objective of the present invention to provide a compact multipurpose dustproof mask which does not contact the mouth and adjacent area thereof so that long term use thereof is possible, and prevents waste of resources since it adopts a replaceable filter structure, and facilitates cleaning and disinfection.

Further, it is another objective of the present invention to provide a compact multipurpose dustproof mask which is compact, very cheap and easy to keep, so as to be kept at places such as public bars, lodging houses, offices, work places, and houses, and by an individual for emergency.

To accomplish the above objectives of the present invention, there is provided a compact multipurpose dustproof mask includes a body pipe having an outlet hole formed at one end and a mouth contact hole formed at the other end thereof, and the end where the mouth contact hole is formed is held in the mouth and/or nose, a backward flow preventing ball installed to be capable of moving back and forth and pressed by a returning means in a direction to block a narrow hole formed inside the body pipe so that the body pipe can be open/shut according to pressure of internal air, and a branch pipe formed between the mouth contact hole of the body pipe and the backward flow preventing ball, the branch pipe having an inlet hole having a shape corresponding to a filter formed at one end thereof so that the filter is connected.

It is preferred in the present invention that the body pipe has a streamlined cylindrical shape having a low profile, and a nose plug is installed to be connected to the outer surface of the body pipe, that the branch pipe is connected to an oxygen container, and that cords to be hooked around the ears are connected to the body pipe.

Also, it is preferred in the present invention that the mask further comprises a mouth covering mask including cords to be hooked around the ears and a cover cloth having a through hole through which the body pipe and the branch pipe pass.

Also, it is preferred in the present invention that the returning means is any of the buoyancy of a gas lighter than air which is filled in the backward flow preventing ball, a returning spring, self-weight of the backward flow preventing ball, and a magnetic force on the backward flow preventing ball.

BEST MODE FOR CARRYING OUT THE INVENTION

Figure 1:
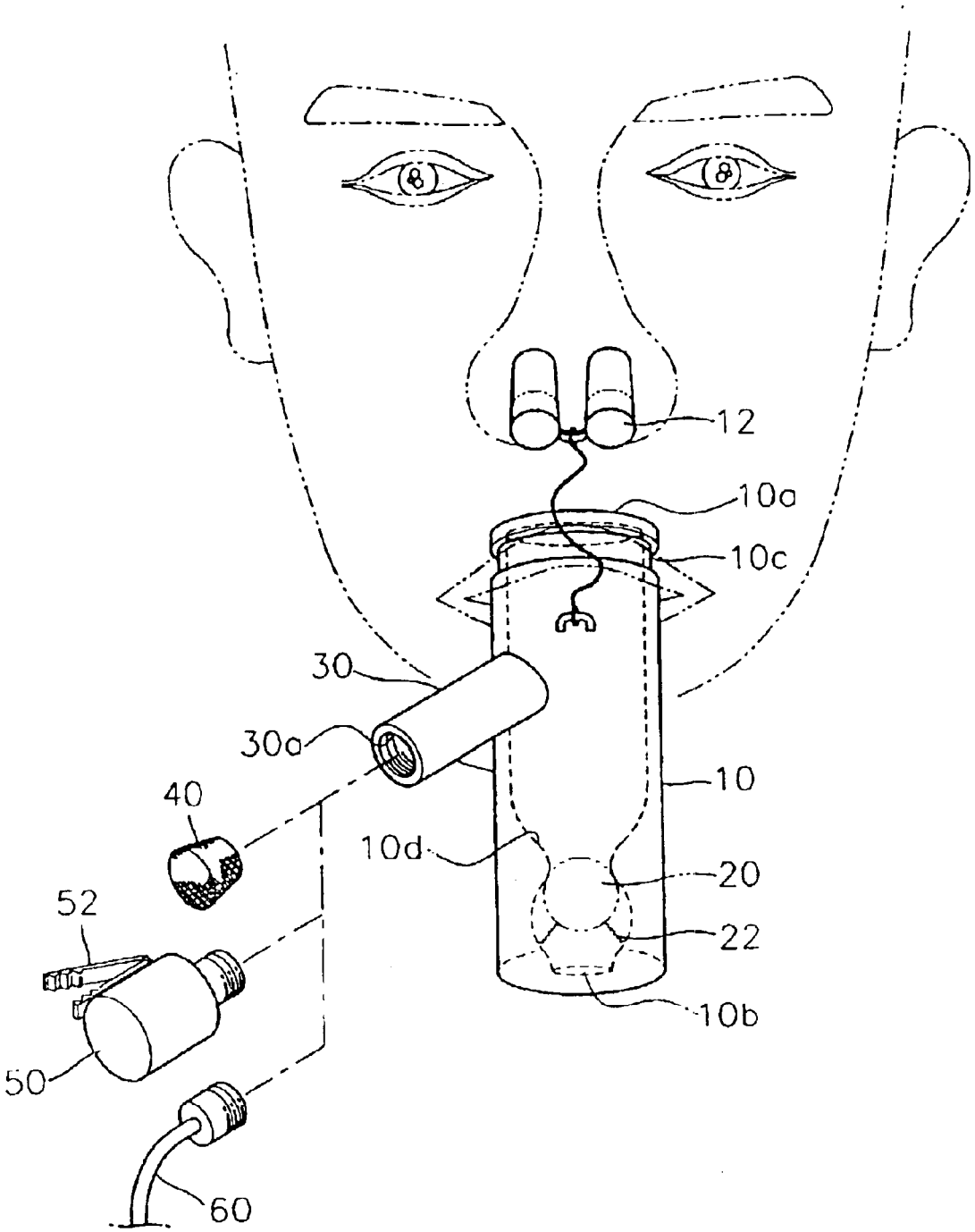
FIG. 1 is a front view showing a compact multipurpose dustproof mask according to a preferred embodiment of the present invention.
Figure 2:
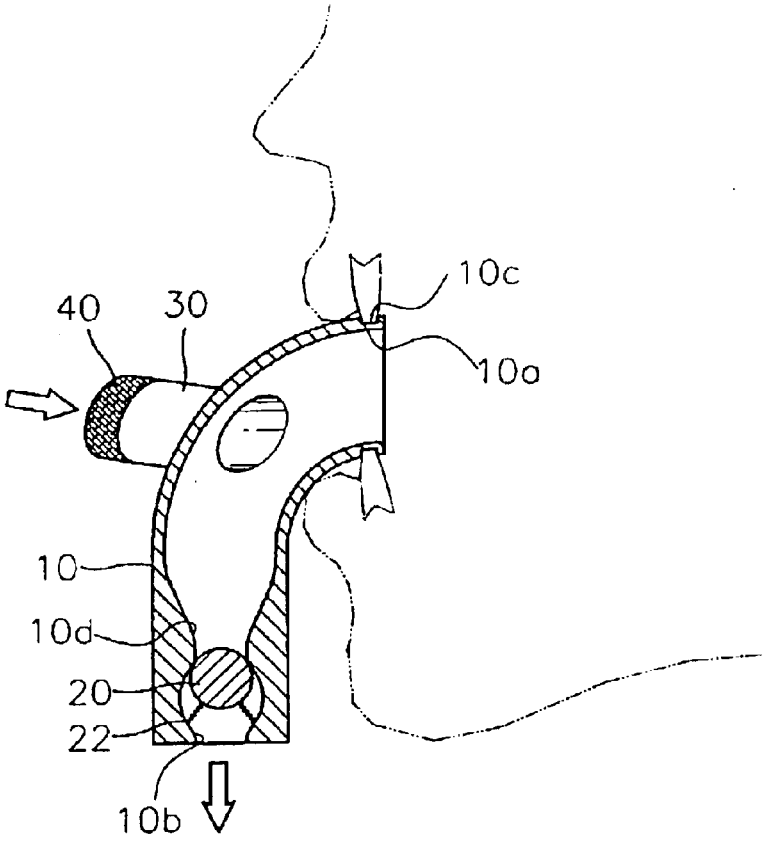
FIG. 2 is a side view of the mask of FIG. 1.

As shown in FIGS. 1 and 2, a compact multipurpose dustproof mask according to a preferred embodiment of the present invention includes a body pipe 10, a backward flow preventing ball 20, and a branch pipe 30. The mask does not cover the mouth and is made to be compact so that it can be easily carried and kept. Also, the mask provides protection from dust and harmful gas by a replaceable filter 40, and an oxygen container can be connected to the mask.

Here, the body pipe 10 is a pipe with an outlet hole 10*b* and a mouth contact hole 10*a* formed at end portions thereof, and a teeth groove 10*c* for firmly holding the body pipe 10 by biting the same is formed at one side end where the mouth contact hole 10*a* is formed.

Although not shown in the drawings, a portion around the mouth contact hole 10*a* of the body pipe 10 may be formed of a soft tube so that in an alternative embodiment the portion can be inserted into the nostrils rather than the mouth and fixedly held by the nose of a user.

The body pipe 10 is manufactured to facilitate breathing of the user, that is, inhalation and exhalation, via the body pipe 10. The body pipe 10 may be formed of thin rubber made from a soft or hard synthetic resin base or a metal base.

Also, the body pipe 10 can be preferably formed of a transparent material so that contamination of the inside of the body pipe 10 can be checked with the naked eyes. The outer appearance of the body pipe 10 preferably has the shape of a streamlined cylinder at the end of which is the mouth contact hole 10*a* having a low profile, so that no gap is generated between the mouth and the body pipe 10 when the user holds the body pipe 10 in the mouth.

Also, the body pipe 10 can be preferably formed to have the shape of the outlet hole 10*b* bending downward. An attachment ring is formed on the outer surface of the body pipe 10 so that a nose plug 12 can be connected thereto on a cord.

The nose plug 12 plugs the nostrils of a user so that the user can only breathe though the mouth. The nose plug 12 can comprise two small cylinders formed of sponge, as shown in the drawing. Also, although not shown in the drawings, a nose plug may have various shapes such as a pincer or cylindrical pipe formed on the body pipe 10.

Also, although not shown in the drawings, instead of the nose plug 12, an additional nose connection pipe which is connected to the body pipe 10 and inserted into the nostrils can be formed, so that a user can breathe both through the mouth and nose.

The backward flow preventing ball 20 is installed to be capable of moving back and forth inside the body pipe 10 and is biased by a returning spring 22 which is a type of returning means in a direction in which a narrow hole 10*d* formed inside the body pipe 10 is blocked so that the body pipe 10 can be open or shut according to the pressure of internal air.

Figure 3:
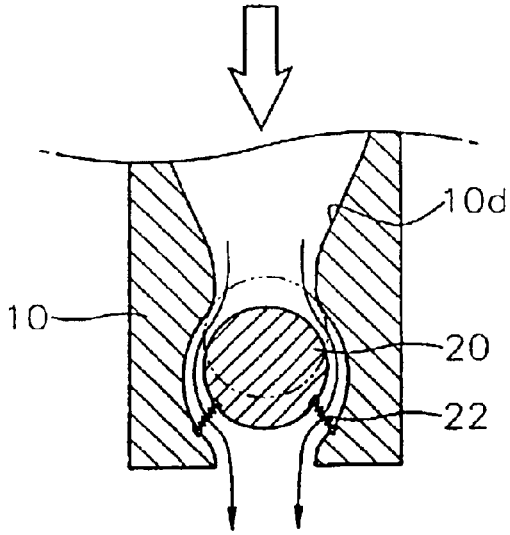
FIG. 3 is a partially enlarged view of the backward flow preventing ball.

Thus, as shown FIG. 3, the body pipe 10 is open or shut according to the reciprocating movement of the backward flow preventing ball 10. When air pressure inside the body pipe 10 is increased as a user exhales, the internal air pressure increases over a returning force of the returning spring 22. Then, the backward flow preventing ball 20 is moved away from the narrow hole 10*d* so that the narrow hole 10*d* is open. Thus, the internal air in the body pipe 10 passes through the narrow hole 10*d* and is exhausted through the outlet hole 10*b*.

Figure 4:
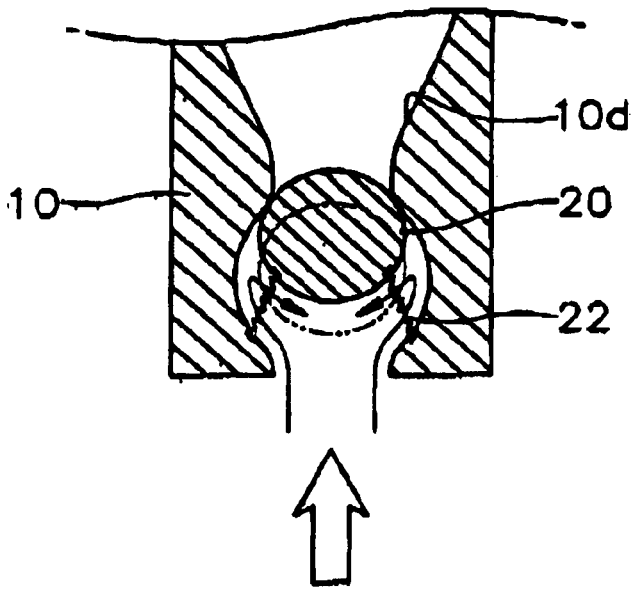
FIG. 4 is a partially enlarged view showing a state in which the backward flow preventing ball of FIG. 3 blocks the narrow hole.

Next, as shown in FIG. 4, when air pressure inside the body pipe 10 is decreased by the exhalation of the user, the internal air pressure becomes weaker than the returning force of the returning spring 22. Then, the backward flow preventing ball 20 retreats by the returning force of the returninging spring 22 and the pressure by the external air applied to the backward flow preventing ball 20 so that the narrow hole 10*d* is closed. Thus, contaminated air outside the body pipe 10 can be prevented from coming into the body pipe 10.

Here, the inhalation of the user is made through the branch pipe 30 shown in FIGS. 1 and 2. The branch pipe 30 is formed between the mouth contact hole 10*a* and the backward flow preventing ball 20 of the body pipe 10. An inlet hole 30*a* having a shape corresponding to a filter 40 is formed at one side portion of the body pipe 10 so that the filter 40 can be connected.

Here, the filter 40 can be replaced by various kinds of filters such as dust or gas filters according to its purpose, and fixed to the inlet hole 30*a* by one of various coupling means such as a simple forced insertion type or a detachable type. Also, the filter 40 is formed of sponge, paper, cloth, a porous material or charcoal so that dust or gas can be filtered.

In particular, in the compact multipurpose dustproof mask of the present invention, a plurality of labyrinthine holes are formed in a dustproof filter facilitating breathing of the user. Here, a sticky type filter can be installed, in which sticky fluid is coated on the labyrinthine holes so that contaminants in the air passing through the labyrinthine holes are caught by the sticky fluid.

Also, a filter including moisture may be used to control the humidity of inhaled air. A filter having a valve for preventing a backward flow may be used or such a valve may be additionally installed at the branch pipe 30.

Thus, a contaminated filter can be replaced by new filters so that sanitory use thereof is possible. Also, since only completely used filters are replaced, more economical and environment friendly use is possible.

The technologies relating to the filter 40 are well known and thus can be easily changed and modified by one skilled in the art within the scope of the present invention.

Also, since a screw thread or an attaching groove is formed at the branch pipe 30, the filter 40 as well as the additional oxygen container 50 can be directly connected to the branch pipe 30. Or the oxygen container 50 can be connected by a connection hose 60.

Here, it is preferably to use a compact high pressure oxygen container which is easy to carry as the oxygen container 50. To distribute self-weight, a clip 52 is formed so that the oxygen container 50 can be firmly held by a shirt or jacket collar or in a pocket of a user.

The oxygen container 50 can be manufactured to be capable of providing oxygen at a pressure weaker than the returning force of the returning spring 22 of the backward flow preventing ball 20, or controlling a degree of opening/shutting according to the amount of oxygen consumed by the user.

The control of a degree of opening/shutting can be achieved by installing an opening/shutting valve. There are various shapes and types of the opening/shutting valve for the oxygen container 50.

Thus, the compact multipurpose dustproof mask of the present invention can be used to enable breathing in the event of a fire, or to help medical patients suffering from pulmonary diseases at the hospital or home or during treatment.

Figure 5:
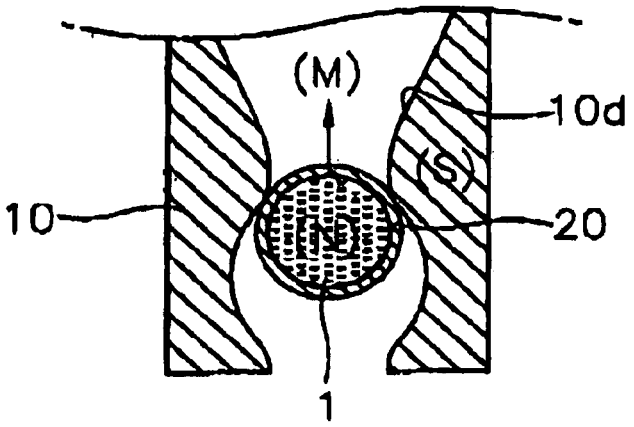
FIG. 5 is a partially enlarged view of the backward flow preventing ball according to another preferred embodiment of the present invention.

As shown in FIG. 5, to press the backward flow preventing ball 20 toward the narrow hole 10*d* without the returning spring 22, a backward flow preventing ball 20 filled with gas 1 which is lighter than air may be used so that the backward flow preventing ball 20 can be raised.

Here, gases such as hydrogen, helium, or nitrogen can be used as the gas 1 which is lighter than air. The backward flow preventing ball 20 may be formed into a light and thin balloon type ball.

Thus, when the pressure of the air exhaled by the user is greater than the buoyancy of the backward flow preventing ball 20, the backward flow preventing ball 20 is moved away from the narrow hole 10*d* so that the body pipe 10 is open. Thus, the air in the body pipe 10 is exhausted outside through the outlet hole 10*b*. When the user inhales air, the backward flow preventing ball 20 retreats so that the body pipe 10 is closed. Thus, the outside air is prevented from coming into the body pipe 10 and the user can inhale the air filtered by the filter 40 or oxygen in the oxygen container 50 through the inlet hole 30*a* of the branch pipe 30.

Figure 6:
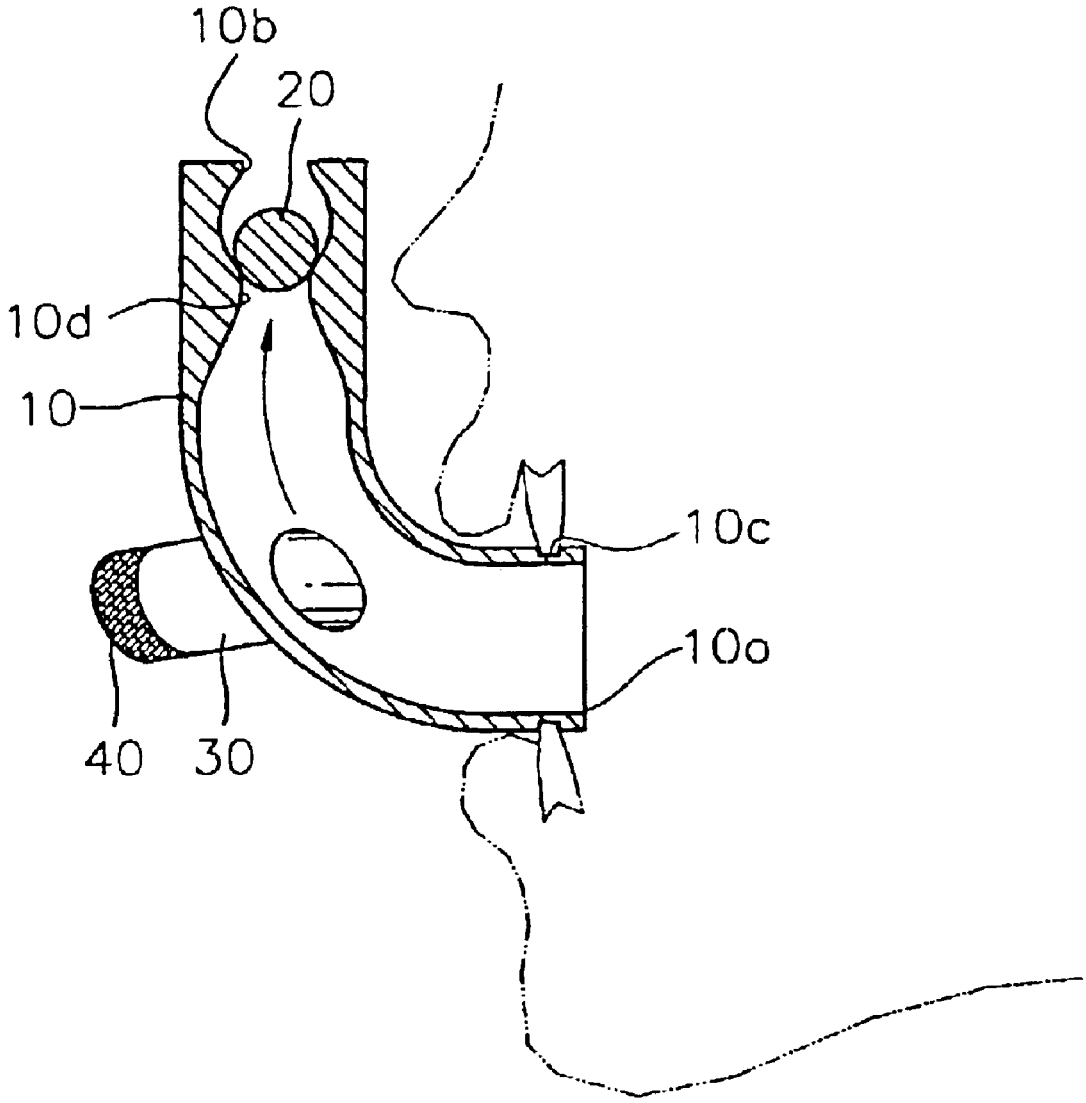
FIG. 6 is a side view showing a compact multipurpose dustproof mask according to another preferred embodiment of the present invention.

Also, as shown in FIG. 6, the self-weight of the ball can be used as the returning means. Here, the body pipe 10 is bent upward so that the backward flow preventing ball 20 can close the narrow hole 10*d* due to the self-weight of the backward flow preventing ball 20.

Thus, when the pressure of the air exhaled by the user is greater than the self-weight of the backward flow preventing ball 20, the backward flow preventing ball 20 raises so that the body pipe 10 is open. Thus, the air inside the body pipe 10 can be exhausted outside through the outlet hole 10*b*. When the user inhales air, the body pipe 10 is closed as the backward flow preventing ball 20 is lowered due to the gravity. Thus, the external air is prevented from coming into the body pipe 10 and simultaneously the user can inhale the air filtered by the filter 40 or oxygen in the oxygen container through the inlet hole 30*a* of the branch pipe 30.

In addition to the above, a magnetic force can be used as the returning means. Although not shown in the drawings, a magnetic body may be installed at the backward flow preventing ball 20 and at the body pipe 10 so that a magnetic force such as an attractive force or a repulsive force can be formed. Thus, in a normal state, the backward flow preventing ball 20 blocks the narrow hole 10*d* due to the magnetic force on the backward flow preventing ball 20. When the pressure of the air exhaled by the user is greater than the magnetic force on the backward flow preventing ball 20, the air is exhausted outside.

Figure 7:
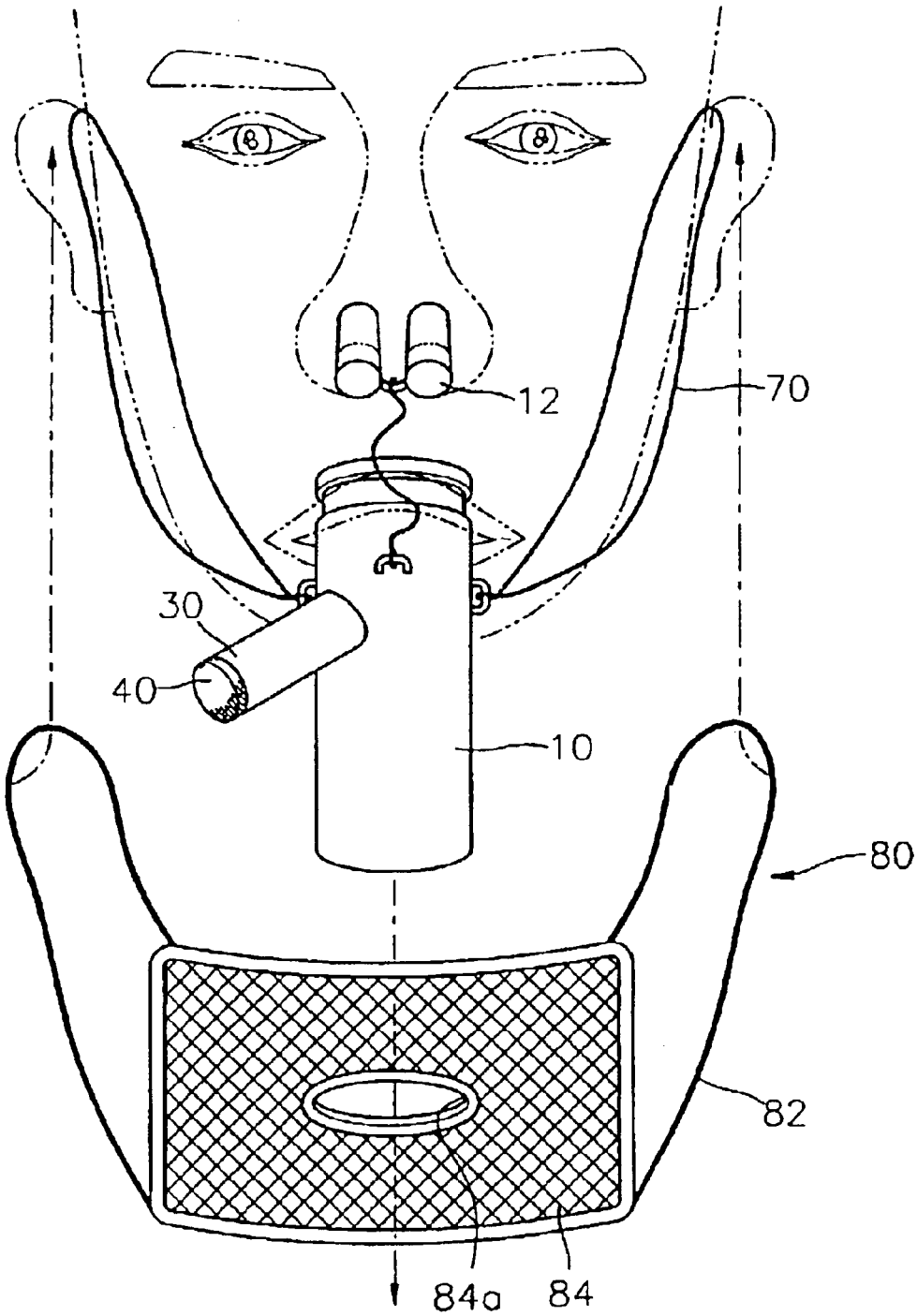
FIG. 7 is a side view showing a compact multipurpose dustproof mask according to yet another preferred embodiment of the present invention.

As shown in FIG. 7, cords to be hooked around the ears are connected to the body pipe 10 to facilitate wearing of the compact multipurpose dustproof mask of the present invention. Also, the compact multipurpose dustproof mask of the present invention can be used together with an additional mouth cover mask 80 which prevents a portion around the mouth from contacting outside air.

The mouth cover mask 80 includes attachment cords 82 to be hooked around the ears and a cover cloth 84 where a through hole 84*a* through which the body pipe 10 and the branch pipe 30 pass is formed. The mouth cover mask 80 not only provides an aesthetic sense but also protects the mouth and lips by preventing formation of water drops during breathing.

Also, although not shown in the drawings, a cord to be hung around the neck can be connected to the body pipe 10 so that the compact multipurpose dustproof mask of the present invention can be worn around the neck when not being used.

Thus, according to the compact multipurpose dustproof mask according to the present invention, breathing is very easy compared to the conventional gas mask and the manufacturing cost and the size of the mask can be remarkably reduced. Thus, the compact multipurpose dustproof mask according to the present invention can be easily kept at places such as public bars, lodging houses, offices, work places, and houses, and further carried by individuals for an emergency, so that valuable lives can be saved from suffocation during a fire.

As described above, according to the compact multipurpose dustproof mask according to the present invention, breathing is easy, filtering of poisonous gas or oxygen breathing is possible, a loss of lives can be minimized, and sanitory use, cleaning, and disinfection are easy. Also, since the present mask has a compact size and is very cheap, it can be easily kept at places such as public bars, lodging houses, offices, work places, and houses.

Industrial Applicability

The compact multipurpose dustproof mask according to the present invention can be used at such places as public bars, lodging houses, offices, work places, and houses.

What is claimed is:

1. A compact multipurpose dustproof mask comprising:

a body pipe having an outlet hole formed at one end and a mouth contact hole formed at the other end thereof, and the end where the mouth contact hole is formed is held in the mouth or nose;

a backward flow preventing ball installed to be capable of moving back and forth and pressed by a returning means in a direction to block a narrow hole formed inside the body pipe so that the body pipe can be open/shut according to pressure of internal air; and a branch pipe formed between the mouth contact hole of the body pipe and the backward flow preventing ball, the branch pipe having an inlet hole having a shape corresponding to a filter formed at one end thereof so that the filter is connected.

2. A mask as claimed in claim 1, wherein the body pipe has a streamlined cylindrical shape having a low profile, and a nose plug is installed to be connected to the outer surface of the body pipe.

3. A mask as claimed in claim 1, wherein the branch pipe is so connected to an oxygen container.

4. A mask as claimed in claim 1, wherein the returning means is a buoyancy of a gas, lighter than air, which is in the backward flow preventing ball.

5. A mask as claimed in claim 1, wherein the filter is a sticky type filter in which a plurality of labyrinthine holes are formed in the filter and sticky fluid is coated on the labyrinthine holes so that contaminants included in air passing through the labyrinthine holes are caught by the sticky fluid.

6. A mask as claimed in claim 1, wherein cords to be hooked around the ears are connected to the body pipe.

7. A mask as claimed in claim 1, further comprising a mouth covering mask including cords to be hooked around the ears and a cover cloth having a through hole through which the body pipe and the branch pipe pass.

8. A mask as claimed in claim 1, wherein the returning means is a spring.

9. A mask as claimed in claim 1, wherein the returning means is a weight of the backward flow preventing ball.

10. A mask as claimed in claim 1, wherein the returning means is a magnetic force on the backward flow preventing ball.

11. A compact multipurpose dustproof mask comprising:

a body pipe having an outlet hole formed at one end and a mouth contact hole formed at the other end thereof, and the end where the mouth contact hole is formed is held in the mouth or nose;

a backward flow preventing ball installed to be capable of moving back and forth and biased by a magnetic force in a direction to block a narrow hole formed inside the body pipe so that the body pipe can be open/shut according to pressure of internal air; and a branch pipe formed between the mouth contact hole of the body pipe and the backward flow preventing ball, the branch pipe having an inlet hole having a shape corresponding to a filter formed at one end thereof so that the filter is connected.

12. A compact multipurpose dustproof mask comprising:

a body pipe having an outlet hole formed at one end and a mouth contact hole formed at the other end thereof, and the end where the mouth contact hole is formed is held in the mouth or nose;

a backward flow preventing ball installed to be capable of moving back and forth and biased by at least one spring in a direction to block a narrow hole formed inside the body pipe so that the body pipe can be open/shut according to pressure of internal air; and a branch pipe formed between the mouth contact hole of the body pipe and the backward flow preventing ball, the branch pipe having an inlet hole having a shape corresponding to a filter formed at one end thereof so that the filter is connected.

13. A mask as claimed in claim 1, wherein two springs are positioned between the outlet hole and the backward flow preventing ball.

* * * * *